US010237952B2

(12) United States Patent
Saes et al.

(10) Patent No.: US 10,237,952 B2
(45) **Date of Patent: *Mar. 19, 2019**

(54) LED FIXTURE AND LED LIGHTING ARRANGEMENT COMPRISING SUCH LED FIXTURE

(71) Applicant: EldoLab Holding B.V., Son en Breugel (NL)

(72) Inventors: Marc Saes, Eindhoven (NL); Petrus Johannes Maria Welten, Oss (NL)

(73) Assignee: EldoLab Holding B.V., Son en Breugel (NL)

( * ) Notice: Subject to any disclaimer, the term of this patent is extended or adjusted under 35 U.S.C. 154(b) by 0 days.

This patent is subject to a terminal disclaimer.

(21) Appl. No.: 15/462,171

(22) Filed: Mar. 17, 2017

(65) Prior Publication Data

US 2017/0339768 A1 Nov. 23, 2017

Related U.S. Application Data

(63) Continuation of application No. 14/426,409, filed as application No. PCT/NL2013/050653 on Sep. 10, 2013, now Pat. No. 9,629,221.
(Continued)

(30) Foreign Application Priority Data

Sep. 13, 2012 (NL) ..... 2009458

(51) Int. Cl.
*H05B 37/02* (2006.01)
*H05B 33/08* (2006.01)

(52) U.S. Cl.
CPC ..... *H05B 37/0254* (2013.01); *H05B 33/089* (2013.01); *H05B 33/0842* (2013.01);
(Continued)

(58) Field of Classification Search
USPC ..... 315/129
See application file for complete search history.

(56) References Cited

U.S. PATENT DOCUMENTS 5,373,453 A 12/1994 Bae
7,642,730 B2 1/2010 Dowling et al.
(Continued)

FOREIGN PATENT DOCUMENTS

CN 1862275 A 11/2006
CN 102160462 A 8/2011
(Continued)

OTHER PUBLICATIONS

PCT Search Report for PCT/NL2013/050653, dated May 26, 2014.
(Continued)

*Primary Examiner* — Don Le
(74) *Attorney, Agent, or Firm* — Hoffmann & Baron, LLP

(57) ABSTRACT

An LED fixture includes at least one LED; an electrical power terminal, electrically connected to the LED, the electrical power terminal for electrically connecting the LED to an LED driver, a storage device for storing data in relation to the LED, and a data processing device, electrically connected to the storage device for storing data in the storage device and reading data therefrom, the data processing device being arranged and connected for providing data communication via at least one of the electrical power terminal and the LED.

39 Claims, 5 Drawing Sheets

Related U.S. Application Data

(60) Provisional application No. 61/699,085, filed on Sep. 10, 2012.

(52) U.S. Cl.
CPC ..... *H05B 33/0845* (2013.01); *H05B 33/0857* (2013.01); *H05B 33/0893* (2013.01)

(56) References Cited

U.S. PATENT DOCUMENTS

| | | | | |
|---|---|---|---|---|
| 8,308,308 | B2 | 11/2012 | Kimura | |
| 8,760,262 | B2 * | 6/2014 | Veskovic | H05B 37/0254 315/312 |
| 2005/0169643 | A1 | 8/2005 | Franklin | |
| 2006/0056855 | A1 | 3/2006 | Nakagawa et al. | |
| 2006/0232394 | A1 | 10/2006 | Patel | |
| 2009/0160627 | A1 | 6/2009 | Godbole | |
| 2011/0043117 | A1 | 2/2011 | Kim et al. | |
| 2012/0081009 | A1 | 4/2012 | Shteynberg et al. | |
| 2012/0187847 | A1 * | 7/2012 | Hamamoto | H05B 33/0815 315/125 |
| 2012/0206050 | A1 | 8/2012 | Spero | |
| 2012/0235595 | A1 | 9/2012 | Busse et al. | |
| 2013/0044827 | A1 | 2/2013 | Vladan et al. | |
| 2013/0049599 | A1 * | 2/2013 | Logiudice | H05B 33/083 315/122 |
| 2014/0111104 | A1 * | 4/2014 | Liu | H05B 33/0809 315/200 R |

FOREIGN PATENT DOCUMENTS

| | | | |
|---|---|---|---|
| DE | 102006015053 | A1 | 10/2006 |
| DE | 102007049052 | A1 | 4/2009 |
| EP | 1324641 | A2 | 7/2003 |
| EP | 2012559 | A2 | 1/2009 |
| JP | 2000-222686 | A | 8/2000 |
| WO | 2010/031103 | A2 | 3/2010 |
| WO | 2011/002280 | A1 | 1/2011 |
| WO | 2012/091561 | A1 | 7/2012 |
| WO | 2012/0319586 | A1 | 12/2012 |

OTHER PUBLICATIONS

NL 2009458 Written Opinion dated Apr. 17, 2013.
PCT International Preliminary Report on Patentability for PCT/NL2013/050653; dated Sep. 10, 2012.

* cited by examiner

LED FIXTURE AND LED LIGHTING ARRANGEMENT COMPRISING SUCH LED FIXTURE

CROSS-REFERENCE TO RELATED APPLICATIONS

This application is a Continuation of U.S. application Ser. No. 14/426,409, filed Mar. 6, 2015, which is the National Stage of International Application No. PCT/NL2013/050653 filed Sep. 10, 2013, which claims the benefit of Netherlands Application No. NL 2009458, filed Sep. 13, 2012 and of U.S. Provisional Application No. 61/699,085, filed Sep. 10, 2012, the contents of all of which are incorporated by reference herein.

FIELD OF THE INVENTION

The invention relates to an LED fixture and a LED lighting arrangement comprising such LED fixture.

BACKGROUND OF THE INVENTION

In general, LED based lighting applications are powered from a lighting grid via a so-called LED driver or ballast. Such an LED driver or ballast can e.g. comprise a Buck or Boost power converter or the like.

LED based lighting applications often comprise a plurality of LED fixture (or LED engine) which can be independently controlled or adjusted by a user (via one or more user interfaces). Therefore, LED based lighting applications may, in general, comprise a plurality of LED drivers or ballasts for powering the plurality of LED fixtures. Typically, an LED driver for powering an LED fixture may comprise a power converter (converting an input power such as obtained from a mains supply to an output power suitable for powering the LED fixture) and a control unit for controlling the power converter. As an example, the control unit can e.g. control an output characteristic of the power converter (e.g. a current level of the output power) based on an input signal received from a user interface.

As LED fixtures in general allow for a variety of illumination parameters to be adjusted, a (digital) communication system is often provided between the plurality of LED drivers and user interfaces. Examples of such systems can e.g. comprise communication busses using DALI or 1-10V protocols. As such, an LED based lighting application can in general comprise a plurality of LED fixtures, which can e.g. be powered by a plurality of LED drivers (e.g. connectable to a mains power supply), and one or more user interfaces, the LED drivers and/or LED fixtures and user interfaces being connected by a communication bus such as a DALI communication bus. The communication between the various components connected to the communication bus can e.g. be controlled by a (master) control unit connected to the bus. Such a master control unit, such as a DALI master may also be used to configure the lighting application.

The LED fixture may be exchangeable and form a separate module that may be connected to the LED driver. Such exchangeability may provide a problem with reproducibility of intensities, colors and other characteristics of the lighting application as a whole. For example neighboring fixtures may have aged and have lower intensity at nominal current than the exchanged fixture

SUMMARY OF THE INVENTION

It would be desirable to enhance a functionality of the LED fixture.

Accordingly, according to an aspect of the invention, there is provided an LED fixture comprising:

at least one LED;

an electrical power terminal, electrically connected to the LED, the electrical power terminal for electrically connecting the LED to an LED driver, a storage device for storing data in relation to the LED, and a data processing device, electrically connected to the storage device for storing data in the storage device and reading data therefrom, the data processing device being arranged and connected for providing data communication via at least one of the electrical power terminal and the LED.

The LED fixture may hence provide additional functionality based on the ability to store data (exemplary embodiments will be provided below) an/or to enable communication. Additional electrical connections (for example between the LED fixture and the driver) may be avoided, thereby enabling compatibility with existing solutions. For data communication, use may thus be made of elements that are already available in the LED fixture, namely the connection to the driver via which the driver drives the LED, and/or via a driving of the LED, which may for example provide signaling to the user, or data modulated onto the LED light output, which may be detected and demodulated by a corresponding receiver. Hence, the LED fixture may provide additional functionality (e.g. logging data, storing data, detecting error conditions or defects, and communicate in relation thereto, substantially without adding additional interfaces for communication, as the communication takes place via the existing connection with the driver and/or optically via the LED. The data in relation to the LED may comprise The data in relation to the LED, as stored in the storage device may comprise any data having a relation to the LED, such as LED configuration data, LED operating data, examples of which will be provided in this document.

The storage device may comprise any type of data storage device, such as a digital memory (e.g. a RAM memory, a programmable ROM memory, etc.). The data processing device may comprise any type of data processing device, such as a microcontroller, microprocessor, or any other programmable device, such as an FPGA, PLD, etc. The data processing device and memory may form separate items, however may also be integrated into a single electronic device. The LED or LEDs of the fixture may for example comprise one or more separate LEDs or a plurality of LEDs on a same substrate. The LEDs, the memory and/or processing device may be integrated, e.g. on a single substrate, so as to form a single unit. The electrical power terminal (which may also be referred to as an electrical power contact, electrical contact or a driver interface) may comprise a single electrical contact (such as a pin, socket, connector, SMD connection, or a plug in type, a soldered type, etc.) or a plurality of such electrical contacts. The LED fixture may also be referred to in this document as an LED unit, LED module, LED lighting module, etc. The LED fixture forms an electronic circuit, the data processing device being connected into this circuit in such a way that the data processing device is able to communicate (e.g. communicate with the driver, communicate with an external device, provide an indication to an operator) via the electrical power terminal, i.e. the interface of the LED fixture towards the LED driver and/or via the LED. The data processing device may thereto be connected, e.g. by means of an electric switch, controllable current source, etc., to for example change an LED current, bridge an LED, switch a terminal of the electrical power terminal, or any other suitable circuit connection. The data communication may be one directional, i.e. sending or receiving, or bi-directional.

In an embodiment, the data processing device is electrically connected to the electrical power terminal and being arranged for communication with the driver via the electrical power terminal. Thereby, data communication with the LED driver is provided without requiring additional electrical connections between the LED fixture and the driver.

In an embodiment, the data processing device is arranged for sending data to the LED driver by:

detecting a LED driver output voltage decrease; and sending the data to the LED driver by modulating an impedance of the electrical power terminal when an LED driver output voltage decrease has been observed.

The LED fixture may thus send data to the driver at the moment when a driving pulse by the driver has ended, which may be detected by the data processing device by detecting when an output voltage of for example an output capacitor of the driver decays.

Some possibilities for receiving by, the LED fixture, data from the driver, are provided below In an embodiment, the data processing device is arranged for receiving data from the LED driver by detecting a magnitude of an LED driver current as provided by the LED driver;

comparing the magnitude of the detected LED driver current with a value expressing a nominal LED driver current;

deriving a data bit from the detected LED driver current substantially matching, subceeding or exceeding the nominal maximum current.

A deviation from the nominal current may hence be applied by the driver to form a bit value.

For example, the data processing device may be arranged for determining the data bit value from whether or not the detected LED driver current exceeds the nominal maximum current, whereby the exceeding or not exceeding is translated into a 0 or 1 bit value. Alternatively, the data processing device is arranged for determining the data bit value from whether or not the detected LED driver current substantially matches the nominal maximum current, whereby the matching or not matching is translated into a 0 or 1 bit value. A pattern of e.g. alternatingly too low and too high LED drive current may be applied, so as to keep the LED driver current value in average at its nominal level, hence having less or no effect on average light output. Alternatively, the data processing device may be arranged for determining a value in bits from a deviation of the LED drive current from its nominal value. The processing device may compare the LED drive current to predefined ranges and determine the bit value from the comparison.

In a further embodiment, the data processing device is arranged for receiving data from the LED driver by:

detecting the LED driver output voltage;

detecting if the LED driver output voltage is in a voltage range above zero and below an LED forward ON voltage;

comparing, when the LED driver voltage has been detected to be in the voltage range, the LED driver voltage to a threshold, and deriving a data bit from the exceeding or not exceeding of the threshold.

In a still further embodiment, the data processing device is arranged for receiving data from the LED driver by:

detecting the LED driver output voltage determining a polarity of the LED driver output voltage deriving data from the LED driver output voltage if the polarity is inverse to a forward LED driving voltage.

In order to enable the data processing device of the LED fixture to control a LED light output, in an embodiment, the data processing device is in a circuit connection with the LED for controlling a light output of the LED. In order to change the LED light output, the LED fixture may comprise a switch, connected in series with the LED, a control input of the switch being electrically connected to the data processing device for enabling the data processing device to control the switch.

Alternatively, the LED fixture may transmit data to the LED driver (for example via the electrical power terminal) so as to instruct the LED driver to provide the desired LED driving to achieve the desired LED light output. In an embodiment, the data processing device is arranged to provide optical data transmission by the LED fixture by:

sending an instruction signal via the electrical power terminal to the driver, the instruction signal to make the driver drive the LED accordingly to optically transmit the data.

Generally, the control by the data processing device of the LED light output may be used either to allow the processing device to adapt a setting of a light intensity (for example to compensate for aging of the LED) or to allow the LED fixture itself to set the light output, for example to provide signaling, e.g. an optical signaling of an error condition, end of life, etc.

In an embodiment, the data processing device is arranged to provide optical data transmission (i.e. optical communication) by the LED fixture by:

powering and depowering the LED from the electrical power terminal so as to make the LED optically transmit the data accordingly.

Optically receiving data may be performed by the LED fixture comprising a photo amplifier having an output thereof electrically connected to an input of the data processing device. The photo amplifier may be formed by the LED (acting as a photodiode) and an electronic amplifier having an input thereof connected to the LED, so as to use the LED as a photodiode.

The optical data transmission may be applied for different uses, as will be described in this document. In an embodiment, the data processing device is arranged for activating the LED in case a predetermined operating condition is established, so as to allow to signal the predetermined operating condition, for example to a user.

In an embodiment, the data processing device is arranged for storing an accumulated operating time of the LED fixture in the storage device, the data processing device being arranged for generating an end of life signal using the accumulated operating time. Hence, the operating condition of end of life of the LED fixture may be signaled. The data processing device may be arranged for transmitting the end of life signal by activating the LED (e.g. pulse wise powering the LED from the power provided by the drive at to the electrical power terminal, so as to e.g. provide signaling pulses, e.g. pulse wise activating a red LED of the fixture for signalling). The data processing device may in an embodiment be arranged for:

connecting for a signaling time period by means of the switch the LED to a supply for generating a signaling optical pulse.

In order to signal a possible defect by having exceeded a safe operating region, in an embodiment, the data processing device is arranged for:

detecting an operating parameter of the LED comparing the detected operating parameter to a safe operating rating; and disconnecting the LED from the electrical power terminal in case a safe operating rating is exceeded. The operating parameter may comprise at least one of: LED temperature, LED current, LED voltage, LED power, LED current as a function of temperature. Furthermore, the operating parameter may comprise at least one of an accumulated number of power-ups, an occurrence of error conditions, an occurrence of LED driver changes, the processing device being arranged for storing the operating parameter (or a derivative thereof) in the storage device.

In an embodiment, the data processing device is arranged for gathering and storing in the storage device at least one of LED operating voltage data, LED operating current data, LED operating temperature data, LED optical output data, LED position data, audio data, video data and for deriving a control signal from the stored data.

In an embodiment, the data processing device is arranged for controlling at least one of a LED intensity and LED color or other LED fixture output characteristic (such as controlling a heat sinking by a cooler, driving an actuator for controlling a position and/or direction of a light bundle emitted by the fixture, providing an optical filter in an optical beam of at least one LED of the fixture, etc.) using the data stored in the storage device. For example an intensity correction over a lifetime of the LED may be performed thereby, Thereto, in an embodiment, the data processing device is arranged for controlling the LED intensity using the operating parameter as stored in the storage device, the operating parameter preferably comprising the accumulated operating time of the LED. The LEDs may be controlled such as to dim an intensity thereof when new, and gradually reduce the dimming when the LEDs age.

In order to take account of an intensity level when determining the operating time, in an embodiment, the processing device is arranged for determining an accumulated operating time of the LED, detecting a dimming level of the LED and correcting the accumulated operating time for the dimming level. As a possible alternative, the processing device is arranged for adding a number of LED current drive pulses provided to the LED, and for determining an accumulated operating time of the LED from the accumulated number of LED drive pulses. The processing device may be arranged for determining the accumulated operating time per LED group of the LED fixture.

A defective LED may be detected, for example from an operating voltage thereof not matching an operating voltage the LED would have when working properly, and once the broken LED is detected, appropriate actions may be taken by the fixture. For example, the data processing device may be arranged for detecting if an LED of the fixture is defective, and for controlling the LED intensity on the basis thereof. Also, the data processing device may be arranged for detecting if an LED of the fixture is defective (e.g. provides a short circuit), and for de-activating the defective LED on the basis thereof.

In a further embodiment, the processing device is arranged to read from the memory device an identification of the LED fixture, and to transmit the identification via at least one of the electrical power terminal and the LED. The identification of the LED fixture may hence be stored and read out, e.g. automatically. The identification may comprise at least one of LED fixture manufacturer identification, LED fixture model name/type identification, LED fixture serial number, LED fixture configuration data.

In an embodiment, the data processing device is arranged for sending data to the driver in response to receiving from the driver a polling signal, so as to for example allow the LED fixtures to work in a slave mode under control of the LED driver acting as a master.

The data processing device may be arranged for sending in response to receiving the polling signal, a response signal for indicating to the LED driver that the LED fixture has an event to report, the data processing device further being arranged to send data to the LED driver concerning the event, in response to receiving from the LED driver a message comprising an identifier of the LED fixture. The communication of the LED driver and the LED fixture or devices may be arranged in an alternating fashion, the LED driver, operating as master, can provide a polling signal to the lighting devices (operating as slaves) whereupon the lighting devices can send a response signal in order to inform the LED driver whether or not the lighting devices have an event to report; such event e.g. corresponding to the provision of data, such as control signal based on configuration data or operating data. The An effect of providing a polling signal (by the LED driver) and a response signal (by any of the LED fixtures) may be that the amount of power needed to perform the polling may be minimalized. Further, when the polling signal is not followed by a response signal, the data processing device of the LED driver does need not start the query because there is no event to report. This has been found to be particularly useful since minimizing power is needed to achieve the very strict standby or low power requirements of the lighting industry. The avoidance of unnecessary data traffic may also be particularly useful since the bandwidth of the communication between driver and LED fixture can be low, i.e. down to 1 bit per light modulation period which can subceed 100 bit per second.

The data processing device may be arranged to synchronize an operation of the LED fixture with a rate of the polling signal received. In an embodiment, the polling signal is provided by the LED driver at a predetermined rate. This rate can e.g. be related to a refresh rate of set-points of an output characteristic of the LED fixture or, via the driver, to some external rate such as the image capturing rate of a camera. The polling signal may be applied by the LED fixture for synchronization as well. As such, in case the LED fixture comprises a sensor, the sensing by the sensor of e.g. an ambient condition or a characteristic of the LED fixture takes place in synchronism with the polling signal. By doing so, one can ensure that, assuming the output characteristics of the LED fixture are refreshed at the same rate, an output characteristic of the LED fixture is not altered during a sensing operation of for example a sensor.

According to an aspect of the invention, there is provided an LED lighting arrangement comprising
an LED fixture according to the invention, and
an LED driver for driving the LED fixture.

The same or similar effects as may be achieved with the LED fixture according to an embodiment of the invention may also be achieved with the LED lighting arrangement according to the invention. Also, the same or similar preferred embodiments may be provided.

The above and other aspects of the invention will be further explained with reference to the appended drawing and corresponding description, showing non-limiting embodiments, wherein:

BRIEF DESCRIPTION OF DRAWINGS

Throughout the figures, the same or similar reference numerals refer to the same or similar items.

DETAILED DESCRIPTION OF EMBODIMENTS

Figure 1:
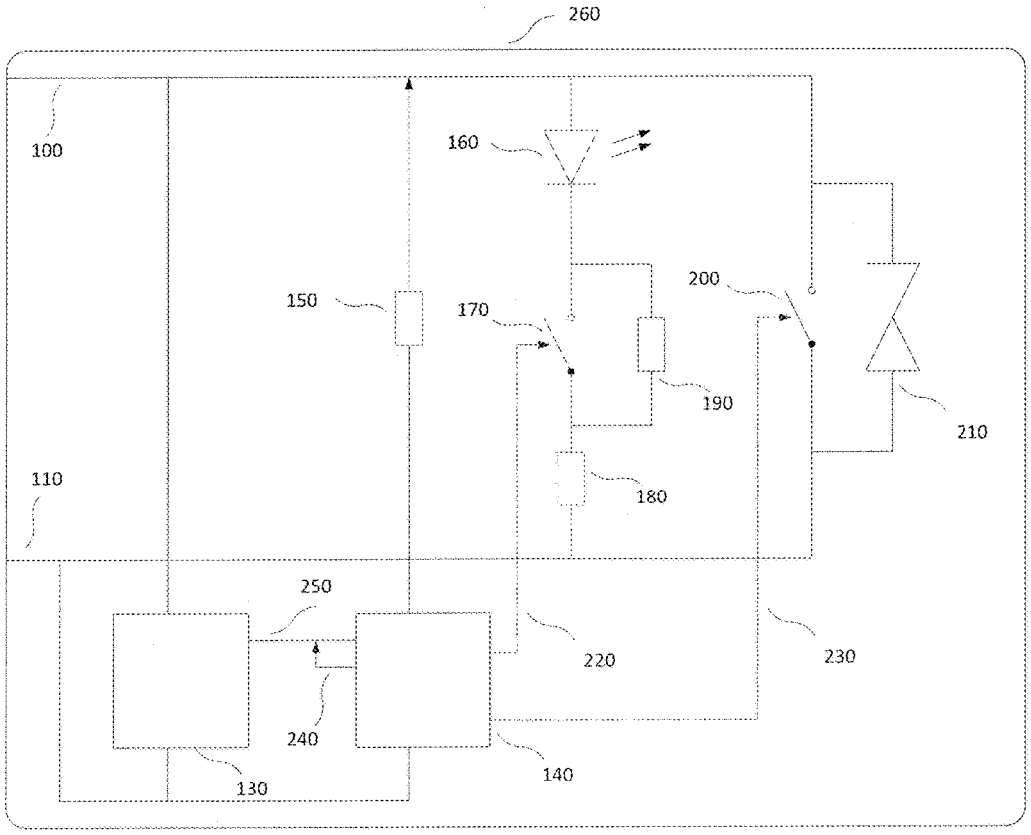
FIG. 1 schematically depicts a circuit diagram of an LED fixture in accordance with an embodiment of the invention.

In accordance with an aspect of the invention, an LED-module (i.e. an LED fixture) may comprise a chip that may measure and log LED-module relevant (internal and/or external [when measurable]) data into a memory area within that chip.

When the LED module is sent back to a manufacturer because of problems, the manufacturer can perform an analysis on the data in the memory part of the chip and can judge if there are grounds to perform the repair for money instead of under warranty, or to learn under what type of circumstances or with what type of driving their LED-modules fail and subsequently improve the design of the LED-module(s).

The LED fixture may also communicate with the LED driver during the normal operational mode (that is giving light of certain intensity/color; dimming; shows; . . . ).

Note that LED-modules are often used with a socketing system such that the LED-module can be easily exchanged by pulling it from its socket and inserting another LED-module. This gives the opportunity to place the data processing device and storage device in the socket and/or in the actual LED-module. For some functions, placing it in the socket may be advantageous. There may be N sockets in a system with 0 to M LED-modules devices in them.

The combination of a storage device and data processing device may also be used in another lighting related object, such as an occupancy sensor, an actuator, etc. Note that these sensors can either be connected directly to the LED-fixture, or that they can be separate nodes in a network etc. Examples are:

occupancy sensor
temperature sensor,
fan,
etc.

The combination of data processing device and storage device may thus also be installed into a module that has no direct lighting element for radiating light (i.e. a sensor module, a fan, a positioning actuator) or mixed forms such as LED-modules having a fan or other type of cooling element, having internal or externally connected sensors and actuators.

The communication between a LED module and its controlling or connecting environment (driver, analysis environment, socket), can be electrical, optical, capacitive, inductive, RF etc.

The data processing device and memory may allow the fixture to measure quantities, log quantities, communicate off-line with an analysis environment. The measured quantities may be internal to the module, or quantities may be measured from I/O connections on the module (f.e. for sensors and actuators, where quantities may for example comprise time, voltages, currents, temperatures, optical quantities, audio quantities, video quantities, positional quantities (position, speed, acceleration, jerk, linear as well as angular, or derivatives such as vibration and shock), trends in these quantities, etc. The communication can be any known communication (wired/protocols; optical; RF; chemical; via movement; etc.)

In an embodiment the LED fixture according to the invention may also send messages to the user by coding the light it produces, for example it may control the RED LED to flash when the guaranteed life time of the LED-module has been reached or when a protection limit has been exceeded (i.e. temperature or current, etc.)

In an embodiment, the fixture will be able to perform functions using one or more of the measured quantities as input and producing one or more results, where one or more of the said results are logged into the memory In an embodiment, the results of the said functions can also be used to control internal and external quantities, i.e. the intensity of light, the balance between a warm white and a cold white LED group, etc.

In an embodiment the fixture may also communicate on-line with suitable drivers, as described in more detail elsewhere in this document. In an embodiment the method (protocol) for on-line communication with the driver and off-line communication are the same. Same protocol may provide the least HW overhead and/or product family members. Different protocols may be applied also.

In an embodiment the communication via light can be bi-directional, i.e. enabled by a photodiode [needs reverse bias and strong light (laser?)] in the LED-module, or by using one of the LED's as a photodiode.

The functions available for bidirectional lighting communication can be the same as all other communication between the LED-module and other objects/users (such as driver/analysis environment etc.).

In an embodiment, the LED-module has multiple LED-groups. Each group may have its own data processing device and storage device. LEDs in a group can be switched in series or in parallel. Any mix is possible.

A bidirectional data communication over the LED power lines, i.e. between the LED driver and the LED fixture, via the electrical power terminal, is described below.

As the LED power lines are used, there may be a dependency between the data communication and the power delivery from driver to LED-unit. As the power delivery to the LED-unit can be done in different modes, the data communication may need more modes also. Below first the possible methods of data communication are given in the power delivery mode of "0% to 100% pulse code modulation". The data communication during the existence of other power delivery modes is given afterwards so that it can refer to principles discussed next.

a. From LED-fixture (i.e. LED unit) to driver:
   i. At the end of a power pulse: lower current/voltage a fixed step with a steep slope f.e. from 100% to 80%.
   ii. After a fixed short period after event i. stop driving said power pulse from the driver (recessive on capacitor voltage). Then the voltage on the output capacitor will start decreasing from 80% down to 0 according to an exponential curve.
   iii. The LED-unit's controller will detect the negative slope from say 100% to 80% and wait the said fixed period.
   iv. After said wait time in iii., the LED-unit may short the LED power lines or not. When shorting, this can be given the significance of a 1 bit, when not shorting the significance of a '0'-bit.

v. The control unit in the driver detects the different curves after event ii. One curve form will be the standard exponential curve when the LED-unit does not short, f.e. conforming to a '0'-bit. The other curve-form will exhibit a sudden steep negative edge due to the shorting by the LED-unit, f.e. conforming to a '1'-bit. In this way, the driver's control unit can receive the data from the LED-unit.

vi. There are several ways the driver's control-unit can detect the difference between the 2 curve form. These are for example, but not limited to these:

a. placing a threshold detection at a fixed time after the stopping of the power pulse where with 1 curve the curve-amplitude is higher than the threshold and with the other curve, the threshold is lower.

b. Calculating a moving average of the slope of the curve and placing a threshold on this slope value for detection of the difference between the two curve-forms. The threshold can be dynamically adjusted depending on the slope value to compensate for the exponential curve form. When the slope stays close to the predicted value, the LED-unit did not short the LED power lines. When the slope suddenly has a higher absolute value, the LED-unit did short the LED power lines.

vii. In this way 1 bit per power pulse can be transferred. Note also that there must be at least 1 period within the total LED control period T (e.g. lasting 3.3 ms) that the value of the current to the LED-unit is at its low level and at least 1 period within said period T where it is at its high level, in order to have at least 1 event of stopping the power to the LEDs and thus at least 1 communication opportunity per period T. The raw data rate with this method will therefore be 1/T bit/second or higher when communicating on every pulse within the period.

b. From driver to LED-unit i. In one embodiment, the current dimming technique (having multiple levels of current through which duty cycling between 2 values of current amplitude become possible) is used to make the current amplitude 1 step higher than the nominal level on a high power pulse to signal the LED-unit that a new period T has started. For example, the amplitude of the current to the LED-unit on the concerned channel may be raised from 100% to 110%.

ii. The LED-unit will detect this higher level with a peak-detector either directly measuring the current or measuring a derivative value, f.e. a voltage.

iii. Because of the use of the peak-detector:

1. The 110% period can be short, thus not giving a noticeable visual effect (or it can be compensated by lowering a further part of a power pulse from f.e. 100% to 90%).

2. Enables the LED-unit to be relative slow to detect the peak value stored in the peak detector.

3. Enables the control-unit in the driver to be relatively slow and use hardly any of the processor's performance for creating the peak value. Performance for an immediately following communication is not needed, thus enabling the driver to use all its resources for light modulation (such as dimming).

iv. After having detected the peak, the LED-unit can sync its time-base to the period T of the driver.

v. At a fixed time ts within period T, the LED-unit can reset its peak-detector and start waiting for a second peak value of 110% in the period until T ends.

vi. At a fixed time which is slightly larger than ts, the driver may raise the amplitude of the current a second time within period T to communicate f.e. a '1' bit to the LED-unit, or it cannot raise the current a second time, to communicate f.e. a '0' bit to the LED-unit.

vii. The LED-unit will either detect a second peak within T or not, thus receiving a '1'- or a '0'-bit.

viii. In an embodiment, the driver may send current pulses that cause a voltage amplitude at the connected one or more LEDs that is lower than the Vf of the said connected LEDs such that said LEDs do not radiate light. In this way communication between driver and LED-unit can take place in any no-light period during modulation or any reserved no-light period during communication.

ix. With respect to viii even the low voltage used may cause the said LEDs to radiate some light because of the LEDs U-I curve in combination with the LEDs I-radiation transfer curve. To prevent that a circuit with a transistor can be used to short circuit the LED at voltages or currents lower than a threshold that lies above the voltage/current used for data communication but lower than the voltages/currents used for lighting.

x. The LED-unit would need to have a threshold detector between 0V and the current/voltage level used for data communication to receive the bits, and a threshold detector above the current/voltage level used for data communication to detect the difference between lighting pulses and data communication pulses.

xi. Having the basic ability to send 0 and 1 values to the LED-unit, any serial data communication protocol can be used to communicate between driver and LED-unit. For example, a start-code could be used to signal the start of a data frame and an end-code to stop the datagram. This can be augmented with a frame check sequence and agreements on the data contents. In this way, messages can be distributed over multiple dark periods in the light. When the driver always has a minimum of 1 or more dark periods a minimum data rate is always possible. A very efficient protocol would diminish the minimally needed dark period percentage.

xii. In an embodiment, the driver may communicate to the LED-unit by using pulses that are inverse (i.e. polarity reversed) to the lighting pulses. An advantage of this method is that the LEDs will not radiate during data communication because they are reverse biased. The opposite direction may be detected by the LED-unit which may thus distinguish data communication form lighting pulses. Extra hardware may be needed to use this method. This extra hardware can be added in different embodiments. F.e. a simple diode with a high break-down voltage can be used to protect the LEDs. In another embodiment, 2 anti-series zener diodes can be placed across the LEDs to protect them.

xiii. In an embodiment, data can be communicated by using 3 levels of pulse amplitudes by the driver where the LED-unit judges each pulse to have the nominal amplitude or not. When nominal this indicates i.e. a '0' bit, when at the level above nominal or at the level below nominal, a '1' bit is communicated. The driver could keep the average light output substantially constant over a longer time period by using the lower than nominal amplitude when the average light output is higher than targeted by the modulation and by using the higher than nominal amplitude when the average light output is lower than targeted by the modulation. When at 100% modulation, this would mean that only 1 bit per T can be communicated with 1 bits that would be alternately at the higher than nominal value or at the lower than nominal value. At 0% modulation, no communication would be possible unless either the switching off to 0% is done by the LED-unit on command of the driver (the driver itself would stay at minimal contrast to be able to communicate to the LED-unit), or one could use 3 amplitudes of the pulses that are below the LEDs Vf threshold where light is being radiated.

A possible protection of the LED-unit's LED chains in case of a reverse polarity is described below.

a. A series FET can be connected in series with the series chain of LEDs in the typically targeted LED-unit.
b. This enables functionality such as:
   i. start-up EOL indication Based on the LED-unit counting the total amount of time that the LED unit was in use, it can signal it has reached the end of its guaranteed lifetime by flashing one of the LEDs, f.e. the red one.

a. This provides active protection against:
   i. too high temperatures
   ii. too high Iforward
   iii. too high dissipation (the time integral of the forward current over a certain time period)
   iv. too high or too low other critical values, such as Vforward.

Some possible functions of the LED-unit's LED chains in case of a reverse polarity is described below.

a. Across the power bus, functional co-operation between the driver and the LED-Unit can be done. Part of this functionality can be standardized either as part of the LEDcode-3 bus standard or as an extra layer on top of that.
b. Below a number of functions will be detailed. Some functions can be carried out independently by the LED-unit with or without status reading and/or supervisory control by the driver, or stand-alone by the driver or as a co-operation between the
   2. More functions than the ones mentioned are possible.

3A. Some possible LED-unit stand-alone functions (with or without the driver monitoring or controlling at a higher level) are described below.

1. Hour counting (as a basis for f.e. aging-compensation or EOL indication. Details explained there. Other applications may also need this basic function, therefore mentioned as a separate function.).
2. Start-Up EOL indication Based on 'the LED-unit counting the total amount of time that the LED unit was in use', it can signal it has reached the end of its guaranteed lifetime by flashing one of the LEDs, f.e. the red one.

In an embodiment the driver can request whether or not the preset lifetime has been exceeded from the LED-unit.

3. Maximum temperature detection and/or throttling and/or shut-down etc.

In an embodiment, the driver can request whether or not the maximum temperature is reached or has ever been reached, or whether throttling is active or has aver been active and how many hours throttling has been on, etcetera.

4. Maximum I-forward detection/protection.
5. Maximum V-forward detection/protection.
6. Surpassing maximum power of the LED-unit, or of the maximum power set by a regulatory institution directly in the driver (see IP0xx) with details such as how often, how long per event, how long averaged, date/time of occurrence, and any other detail related to the event or the conditions in which the event took place.
7. Measuring I-forward as a function of temperature
8. Measuring Vf and determine LED temperature or LED-unit temperature from that.
9. Event statistics. Several events such as power-up, mode changes, errors occurring, risky conditions occurring, driver change etc. can be counted and stored for later factory return or other analysis, f.e. during an RMA process. Details stored per event can be from the ID of the event and a flag remembering whether or not the event has occurred since the last "history-reset".
10. Controlling light color (light temperature) using series FETs to direct current into a cold-white chain or in a warm-white chain or any balance between the 2. Similar can be done with more colors.
    a. The light color can be made dependent on time of day, ambient light, hours counting, occupancy sensor (i.e. PR switch), switches or other U-I/F controls
    b. a possible method of dimming:
       1. First channel 2 100% and channel 1 dimmed
       2. Also dim channel 2 at lower intensity.
       3. balance (warm-white vs cold-white f.e.) setting in factory (factory calibration)
       4. balance setting with LED driver.
11. Dim over life (dim when LED-unit is young [aka initial dimming] and diminish dimming over time to a) compensate for aging, b) calibrate the module to the specified factory output level for the module-type or c) compensate for broken down LEDs). The LED-unit dims in this case! Not only the driver. Can only be done with drivers that are compatible with the dimming method of the LED-unit (f.e. the serial FET in the LED-channels).
12. Serial number. The storage device can be programmed with the serial number of the LED-module at the factory. This enables relation of all data stored in the storage device to its production history (batch, component origine, etc.). This may pinpoint issues in the factory or with suppliers that can subsequently be improved upon.
13. Defective LED detection or—compensation. When an LED is broken, it typically shorts. Through the measurement of the Vf of this specific LED or of the total Vf of the chain/channel the LED is part of or of the increased If at nominal supply voltage, etc., the data processing device can detect this failure. The data processing device can either communicate this at RMA time, or via lighting signals (flashes according to some code), or to the driver, or the data processing device could compensate for the situation by dimming less [see Dim over Life stand-alone function].
14. Make LED-module "Dim over Life" percentage dependent on the actual forward current versus the nominal current.
15. Some LED-Modules already use a zener-diode or alike device to keep the current running even when the LED they are in parallel to is an "open connection" due to a failing LED. Adjust % dim to compensate for that.

The shorting can also be done using an active component such as an FET controlled by the data processing device.

16. Reserve LEDs or chains of LEDs can be switched on to compensate for failing LEDs/channels.
17. Transmit the EOL condition invisibly via the radiated light i.e. by performing invisible modulation (amplitude or hidden in the edges of the light-pulses, etc.).
18. A separate LED can be used that transmits invisible light for communicating towards the outside world.
19. Transmit the type or serial number or ID or long address or short address etc. of the module via light to aid in the installation purposes (in case the LED-module is connected to a driver inable to communicate with the LED-module; otherwise this can be requested by the driver).
20. Module may detect which type of driver is controlling it and may then choose which functions it activates or not (f.e. the ([in]visible) sending of the ID or alike via light is not needed when the same info can be requested by the driver.)
21. calculations can comprise integrating (or cumulating) functions, f.e. current over time or alike.
22. Conditions to measure: If, Vf, Ifripple, Vf-ripple, Water, Vibration, Shock, Position, Angular position 6DOF, height/depth [air pressure measurement], driver type/serno logging, etc. etc.
23. Protect against too high values in any of these measured values (i.e. If).
24. Change intensity and/or color depending on a positional input (position, speed, acceleration, jerk, angle, rotation, tilt, roll, etc.)
25. Change intensity and/or color depending on other quantities such as temperature, If, Vf, other?
26. Piezo actuator/sensor
27. Double: warm white/cold white balance (or other colors).
28. Colorshift (on purpose and/or for compensation)
29. actuator control: fan, radiation direction, audio (i.e. buzzer), etc.
30. Double: sensor read-in:
31. Dim-range enhancement: Suppose "dumb driver" X can dim from 100% down-to 10%. The LED-Module with data processing device and/or storage device can enhance this from i.e. 1005 down-to 0.1%. This may be dependent on the driving method of the driver X
32. Self-learning.
33. Log driver (installation)changes. First XXX was my driver, then YYY was my driver, then . . . ; possibly with time data (data processing device can have an RTC, or just counts time. May have a memory location to keep absolute time (with a certain uncertainty depending on the HW and SW implementation)).
34. Data storage, what is structure of it, what is size of it? With size there are a number of associated functions, such as setSize( ), getSize( ), etc.

3B. Some possible Co-operative functions of the LED-unit's LED chains in case of a reverse polarity is described below.

1. Store/Read LED-unit Manufacturer ID.
2. Store/Read LED-unit Model name and/or ID (or Type number)
3. Store/Read LED-unit serial number
4. Store/Read LED-unit properties such as:
   a. number of channels
   b. nominal current [possibly per channel]
   c. maximum current and/or SOAR data [possibly per channel]
   d. maximum Vf [possibly per channel]
   e. channel color
   f. amount of LEDs in a channel [possibly per channel]
   g. etc.
5. Store/read/manipulate "trace log"
6. See TEDS (Transducer Embedded Data Sheet) for more functions.
7. Aging Compensation
   h. Aging is the effect that LEDs have a decreasing light output over their lifetime. Lifetime is measured as the amount of time that the LEDs have been ON at nominal current.
   i. The LED-unit is the best object to at least store the amount of hours in that a LED-unit has been on, as the aging. This number will then stay with the LED-unit when it is connected to a different driver, f.e. because the driver broke down and was replaced or because the LED-unit was used at a different location (f.e. in stage applications).
   j. Note that storing aging related figures can also be done outside the LED-unit, such as in the driver, in a local supervisory control such as a PC, in a file or a database on that PC, in a remote database, in magnetic, electrical, optical, chemical or other form, etc.
   k. The measurement of figures related to aging can be from simple to complicated.
   l. In an embodiment, only a general ON/OFF condition is measured, where this ON/OFF condition is independent of the dimming situation. This means that the measurement can be severely wrong when the dimming is set at 0%.
   m. In another embodiment, the actual ON period of each supply pulse to each separate LED is measured and the total amount over the actual lifetime is accumulated in separate storage locations per channel.
   n. In another embodiment, also the amount of times the LEDs from a channel have been switched on is counted and stored as well. Any aging effects based on the amount of actuations may then be compensated for.
   o. With the data thus stored in the storage locations in the LED-unit (or elsewhere), a compensation of the aging effects can be performed, either by the LED (which may have some added intelligence), the LED-unit, the driver or any supervisory controller at any higher hierarchical level, or it can be distributed over these and other objects so that certain objects perform a certain part of the compensation. The driver is currently the best object to perform the compensation, so the remainder of this note will discuss that situation.
   p. In the most complicated measurement embodiment mentioned above, the driver could compensate as follows:
      i. for each channel, for example the Red, Green, Blue and Amber channels, the externally requested setpoint Se is increased with a factor Fo*Ch, where Ch is the amount of ON time of the channel in question and Fo is the compensation factor. This is a linear compensation. Note that Fo may be made dependent on Ch to achieve progressive compensations such as an exponential one.

ii. for each channel an extra compensation factor can be used, where Se is increased with a factor Fp*Ns+Fn*Ns, where Ns is the amount of times the channel has been switched ON and OFF (we abstract from the situation where these may differ by 1 because the LED has been switched ON but not yet OFF, by counting only the ON edges), Fp is the compensation factor for the positive edge and Fn is the compensation factor for the negative edge. Note that again, Fp and Fn can be dependent on Ns as well as other factors such as the average current during the ON time etc.

iii. In an embodiment, also the I-forward through the LEDs is measured and stored for usage in the compensation algorithm.

iv. In an embodiment, the I-forward during a particular pulse ON period is first combined with the ON time period and only the result is stored. This calculation and storing can be done by the LED-unit which then needs an I-forward measurement function, an ON-time measurement function (in an embodiment per channel) and a calculation function. The calculation could be multiplying using a factor Fc: Che=Ch*Fc, where Che is the effective amount of Channel ON time in hours and Fc is the current dependent factor. Fc can hold an offset: Fc=fc+oc, where fc is a current depending factor and oc is a current dependent offset. Several other calculations can be used, for example involving thresholds.

v. An advantage of using this more complex form of measurement and compensation per channel and for multiple channels is, that color shifting due to aging or difference in aging between the LEDs in the separate color channels, can be largely prevented.

8. EOL handling q. In an embodiment the manufacturer decides to warn the customer that the lifetime of an LED-unit has been exceeded by flashing i.e. the red LEDs of said LED-unit.

r. To that end, the manufacturer determines a lifetime for the LED-unit, based on calculations or factory measurements, and determines a number of hours that when exceeded by the actual measured lifetime in the LED-unit leads to the flashing behavior.

s. In an embodiment, the set of lifetime data stored in the LED-unit is read by the driver and used by the driver to control the channel of i.e. red channels to show the flashing behavior.

t. In another embodiment, the set of lifetime data is sent to a controller at some hierarchical level above the driver, which may either control the set-points to the driver to show the flashing behavior, or which may instruct the driver to control one or more of the channels to show the flashing behavior.

u. In an embodiment, the driver may hold an internal show generator and the driver itself or the said controller at some higher hierarchical level may send or select a show that subsequently shows the desired flashing behavior.

v. In an embodiment, the flashing behavior can be coded, either in color or in timing, to convey more than 1 message to the user.

i. as an example a simple 50% ON, 50% OFF repetitive cycle may indicate the EOL condition.

ii. in another example, every second the first 400 ms can be used for a flash code. Such a flash code could start with 3 small flashes of 10% of the flash time of 400 ms with pauses of 10% between them and ending with an ON time of 30%, before the wait time of 600 ms starts to complete the second. Different flash codes can be used for different messages. I.e. a flash code can be used for over-temperature, over-current, over-voltage, etc.

9. Store driver details in the LED-unit (a.o. for Warranty):

w. Manufacturers typically guarantee their product during a guarantee period. Most of the times the products proper functioning is not dependent on the product alone, but also on how the product is installed how the product is used and in what environment the product is used.

x. For manufacturers of LED modules, it may be important to know what drivers have been used to control their LED module as drivers differ in the way they operate the connected LEDs. Some drivers exhibit higher peak voltages or currents than others when controlling an LED-unit at the same externally visible light output.

y. In an embodiment, the LED-unit has one or more storage location where one or more data sets can be stored. Such a data set can be written by a driver writing i.e. the following data:

i. driver manufacturer id ii. driver id iii. first data the driver operated this LED-unit iv. last data the driver operated this LED-unit z. In an embodiment each driver uses its own access code to access its own data-sets. The access code may be judged by the LED-unit in order to grant access or not to the concerned storage. This is to eliminate the possibility that other, later connected drivers, destroy the data sets from previously connected drivers.

aa. LED module manufacturers could then categorize their guarantee period depending on drivers used. for example:

i. 30,000 hrs with a typical driver ii. 50,000 hrs with an LED driver bb.

10. RMA-support/Warranty cc. Gathering data from the driver, driver control (max Vf, If, Pled-unit) and environment (temp, etc.) helps a LED-unit manufacturer to analyze that data after reading it from the LED-unit.

dd. reading the data from the LED-unit ee. clear the data in the LED-unit ff. Service/repair carried out on the LED-unit (Date, who, description)

11. The data processing device and/or memory can hold a model of its composition and behavior that can be read by the driver and used for subsequent control.

The model can be from 1 single simple information item (i.e. nominal forward current) to complex models i.e. a model with sub-models for every driving mode (Analog current, PWM, Hydra, etc) possibly per value of certain conditions such as temperature, nominal voltage, etc.

12. When serial number is known, the driver may a) control the device according to data fetched from a network-service (such as a database service) relating to the device having said serial number, b) store data about the LED-module having said serial number into a local or remote database, c) find the module-type of the device with said serial number and fetch or store data for that type.

13. Download data processing device algorithms and configuration data (a.o. parameters).
14. LED-module category detection (categories f.e.: constant current-compatible/PWM-compatible/Hydra-compatible, etc.)

c. Based on the above functions, co-operation- or bus-protocols can be standardized to be able to connect LED-units of different manufacture to LED drivers of different manufacture. These protocols together with details on physical and data layers would together form a standard.

Some possible embodiments related to LED-modules in series are described below.

In an embodiment, multiple LED-modules can be connected in series to LED drivers.

A command may be provided from driver to module, e.g. a polling command to request the Led fixture (i.e. Led module) to provide data or to request the LED module to indicate if is has data to send.

Compare to CAN recessive addressing (zero bits win; so when multiple units answer at the same time, the one with a 0 in the address at the first differing bit position wins. Similar principle can be applied here.

DALI method: the fixture chooses initial random number to use as address. The master can then communicate with each of them separately in 99.99x % of the cases as the addresses will typically differ (Note the chance on double errors depends also on the amount of nodes in a system). The master node may assign a short address a.o. for convenience and performance improvement.

Some possible embodiments for power transfer over RF are described below.

The data processing device and memory device may be supplied with power from a rectified and stabilized signal received via RF over a coil.

In another embodiment the data processing device and memory device is supplied with electrical power by the LED driver over the LED lines, this may be advantageous in for example the following 2 cases:

when the LED-module is continuously driven at such a low intensity that the power delivered to the LED lines is insufficient to keep the data processing device and memory alive, or, when the periods at which the LED-module is driven via the LED lines are so sparse in time that the device starves before the next power dot arrives.

Circuit Breaker Apparatus

An apparatus that can break the current in a series chain of this apparatus together with 1 or more LED-modules and supplied by a supply, i.e. of the continuous current type.

In FIG. 1 a LED-module (i.e. LED fixture) 260 is shown. The 1 or more LEDs 160 are controlled by applying a current or voltage at electrical power terminals 100 and 110, e.g. by an LED driver (not depicted in FIG. 1). As a result an LED drive current will flow through LED 160 and impedance 180 either through impedance 190 or through switch 170 when it is closed.

Device 140 can comprise a memory device (i.e. a storage device) and/or an intelligent device (i.e. a data processing device) such as an analog circuit, a microcontroller, an FPGA or PLD etcetera.

In case of a memory device it can be preprogrammed at the factory and/or it can be written to and read from through a form of communication over the terminals 100 and 110.

In case of an intelligent device, it can measure several internal or external quantities and store them in internal memory. I.e. it can measure the supply voltage it receives from supply 130. It can measure the approximate Vforward of the LED through impedance 150. In case impedance 180 is known to 140 and the current through it is measured also, 140 can more accurately calculate the forward voltage across said LED(s) 160 in case switch 170 is closed. Controlling switch 170 is performed by device 140 via control line 220. Via switch 200, controlled by control line 230, device 140 can short circuit the terminals 100, 110. Furthermore, the voltage across resistor 190 can be used to calculate the current through the LED in case impedance 180 is zero and the switch is open.

When 140 closes switch 200, current may flow through the LED-module without light being radiated, so that LED-modules can be connected in series and a following, series connected LED-module can be powered. Reversed polarity protection is be provided by parallel by device 210. Device 140 senses its supply voltage, provided at connection 250 by supply 130, at 240.

Figure 2:
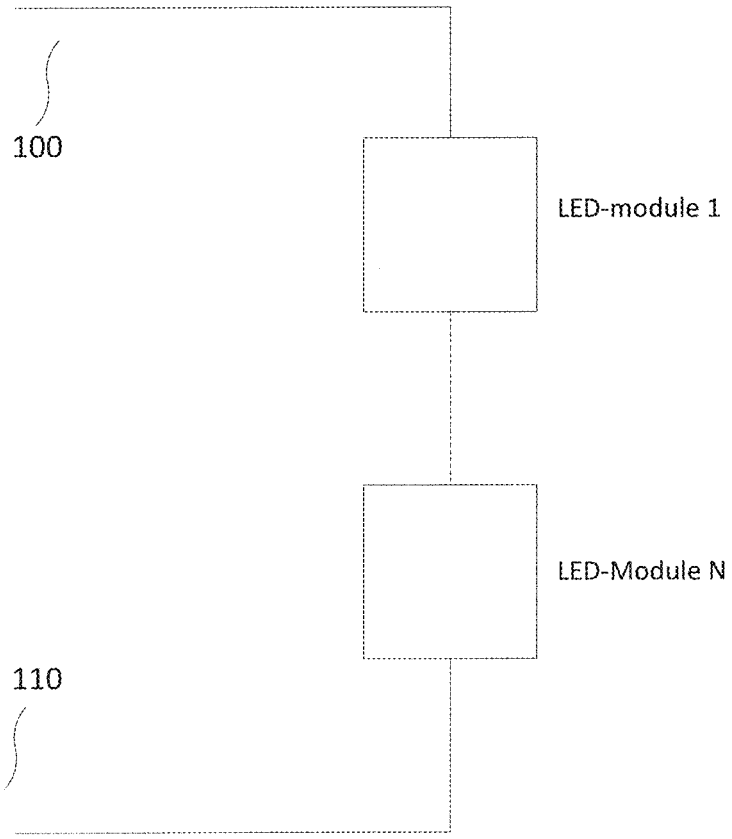
FIG. 2 schematically depicts a block diagram of series connected LED fixtures in accordance with FIG. 1.

FIG. 2 depicts such a series connection of LED modules, powered b a common LED driver via the terminals 100, 110. Applications may further include: the driver may deliver an effective LED drive current which is transformed by each of the series connected fixtures into a corresponding LED intensity by an gain (e.g. in lumen per watt) as stored in each of the series connected LED fixtures. Also, forward voltage correction may be provided by means of characteristics of the LEDs as stored in each fixture, and a unique identification of each fixture (e.g. a serial number) may be stored, e.g. for addressing purposes.

By very fast switching of 170 with a certain balance B between the ON-time and the OFF-time of 170, the module can dim the light radiated by 160. It depends on the type of driver connected to 100/110 whether or not this will deliver reliable/predictable light output. With a driver only delivering a continuous current when switched ON, this type of dimming works. With complex drivers using a dimming strategy of their own, it is dependent on the interference between the driver and the fast switching of 170 whether or not the resulting behavior is as desired. To cope with these different situations, LED-modules could be designed to fit into certain categories, where each category is optimized to deal with a certain external behavior of the driver as observable by the LED-module on terminals 100 and 110.

Figure 3:
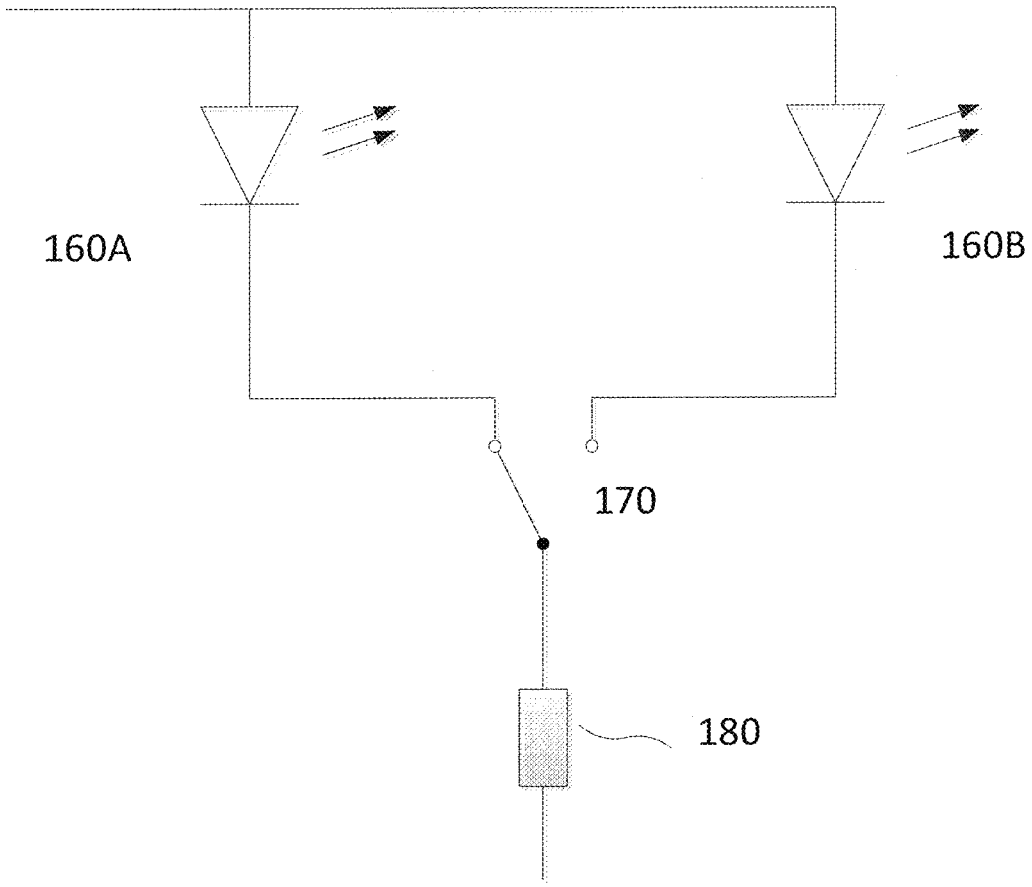
FIG. 3 schematically depicts a circuit diagram of a part of an alternative embodiment of the LED fixture in accordance with FIG. 1.

By duplicating the chain 160, 170, 180 delivering a chain A and a chain B, it becomes possible to control 170A and 170B by the device 140 in such a way that current either flows through the A chain or through the B chain. When choosing the LEDs 160A to radiate warm white light and LEDs 160B to radiate cold white light, and by controlling the ON-time of 1 switch which is substantially the OFF-time of the other 170 switch, it is possible to control the color temperature of the radiated light from the temperature of the cold white LEDs to the temperature of the warm white LEDs. An alternative embodiment is depicted in FIG. 3, where two parallel LEDs (e.g. a cold white one and a warm white one) are connected parallel via a switch which alternates between the two LEDs 160A, 160B. An impedance 180 is connected in series with the switch, having a similar purpose as the impedance 180 in FIG. 1.

Figure 4:
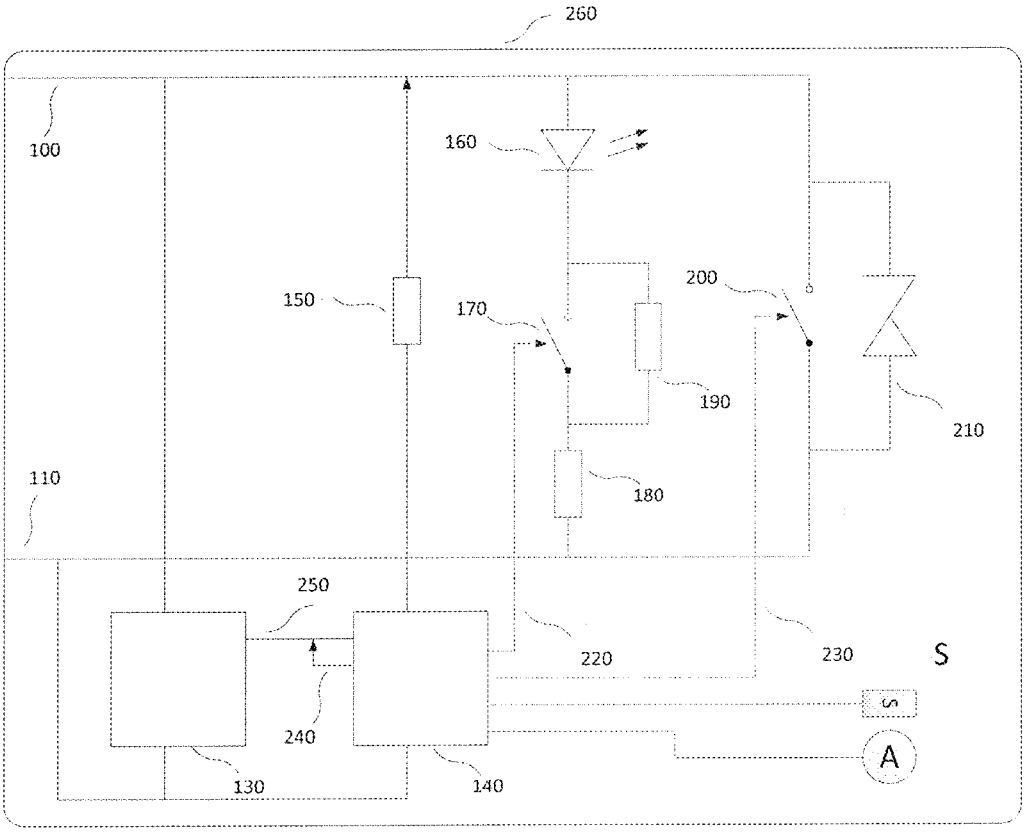
FIG. 4 schematically depicts a circuit diagram of another LED fixture in accordance with an embodiment of the invention.

The device 140 as depicted in FIG. 1 may comprise internal sensors, such as supply voltage, time counting, and/or make use of external signals for sensing, such as the LED drive voltage in order to determine a voltage level, count a number of pulses, etc. Furthermore, sensors may be connected to the device 140, such as an acceleration sensor, a temperature sensor, etc. An example is depicted in FIG. 4, where sensors A and S are depicted.

Figure 5:
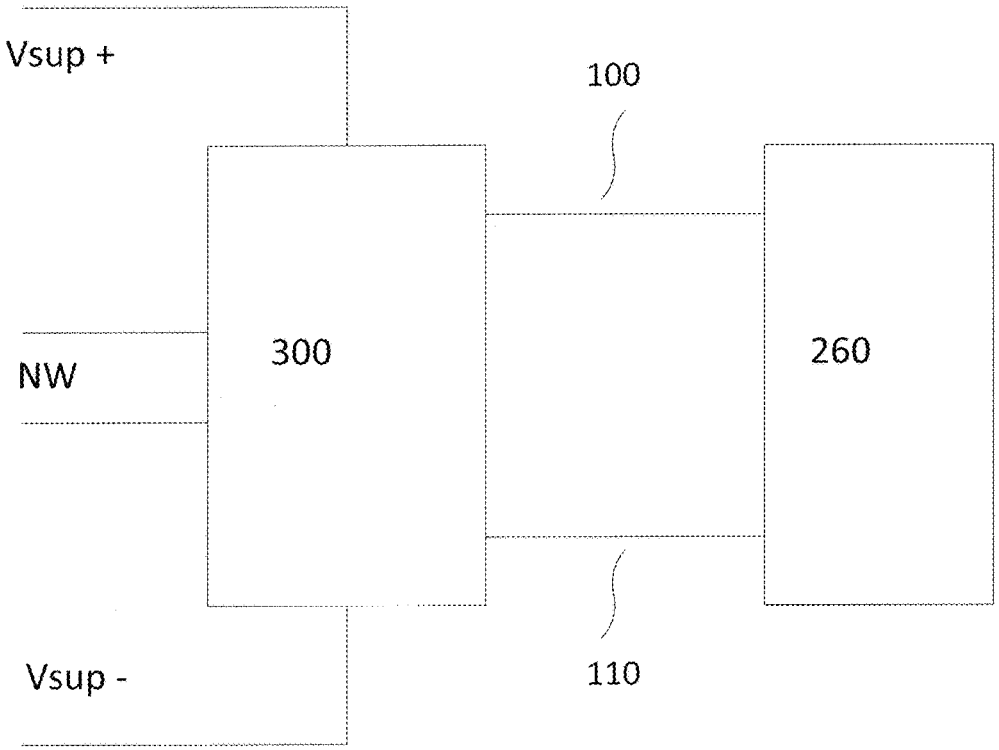
FIG. 5 schematically depicts a block diagram of a lighting arrangement in accordance with an embodiment of the invention.

FIG. 5 depicts a LED lighting arrangement (i.e. an LED lighting assembly) comprising LED driver 300 and LED fixture 260. The LED driver drives the LED fixture via connections 100, 110. Communication (single or b-directional) between the LED driver and the LED fixture is performed via the lines 100, 110 as described in this document. The LED driver is in this example be provided with powering via power lines Vsup+, Vsup−. Data communication with the driver takes place via a network connection NW. The network connection NW on the one hand provides instructions to the driver for driving the LED fixture and on the other hand enables the LED fixture to communicate via the driver with for example a master, show controller, etc.

Although the LED fixture according to the invention may be arranged for communicating via the electrical power terminal and/or the LED, a further communication interface may also be provided in the LED fixture, for example a data communication connection via a separate data communication terminal, e.g. a network connection, or a capacitive, inductive or optical connection.

The ability for the LED fixture according to the invention to communicate, e.g. via the lines with which it in operation is driven by the LED driver, may also be used for service and repair purposes, e.g. to read out data as stored in the storage device, e.g. data that has been logged in the storage device, to program the LED fixture, etc.

As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. Further, the terms and phrases used herein are not intended to be limiting, but rather, to provide an understandable description of the invention.

The terms "a" or "an", as used herein, are defined as one or more than one. The term "plurality", as used herein, is defined as two or more than two. The term "another", as used herein, is defined as at least a second or more. The terms "including and/or having", as used herein, are defined as comprising (i.e., open language, not excluding other elements or steps). Any reference signs in the claims should not be construed as limiting the scope of the claims or the invention.

The mere fact that certain measures are recited in mutually different dependent claims does not indicate that a combination of these measures cannot be used to advantage.

The term coupled, as used herein, is defined as connected, although not necessarily directly, and not necessarily mechanically.

A single processor or other unit may fulfil the functions of several items recited in the claims.

The invention claimed is:

1. An LED lighting module comprising:

at least one LED;

the LED lighting module being configured to be connected to an LED driver module, the LED driver module comprising a converter for converting a power supply voltage into an LED driver module electrical output power for powering the at least one LED of the LED lighting module and a controller for controlling the converter, wherein the LED lighting module is configured to be powered by the LED driver module and wherein the LED lighting module does not comprise a converter for powering the at least one LED, and wherein the LED lighting module further comprises:

an electrical power terminal, electrically connected to the LED, the electrical power terminal for electrically connecting the LED to the LED driver module to power the at least one LED from the LED driver module electrical output power as received from the LED driver module;

a storage device for storing data in relation to the LED; and a data processing device, electrically connected to the storage device for storing data in the storage device and reading data therefrom, the data processing device being arranged and connected for providing data communication via at least one of the electrical power terminal and the LED;

wherein the data processing device is in a circuit connection with the LED for controlling a light output of the LED.

2. The LED lighting module according to claim 1, wherein the data processing device is electrically connected to the electrical power terminal and being arranged for communication with the driver module via the electrical power terminal.

3. The LED lighting module according to claim 1, wherein the data processing device is arranged for sending data to the LED driver module by:

detecting a LED driver module output voltage decrease; and sending the data to the LED driver module by modulating an impedance of the electrical power terminal when an LED driver module output voltage decrease has been observed.

4. The LED lighting module according to claim 1, wherein the data processing device is arranged for receiving data from the LED driver module by:

detecting a magnitude of an LED driver module current as provided by the LED driver module;

comparing the magnitude of the detected LED driver module current with a value expressing a nominal LED driver module current; and deriving a data bit from the detected LED driver module current substantially matching, subceeding or exceeding the nominal LED driver module current.

5. The LED lighting module according to claim 4, wherein the data processing device is arranged for determining the data bit value from whether or not the detected LED driver current exceeds the nominal LED driver module current.

6. The LED lighting module according to claim 4, wherein the data processing device is arranged for determining the data bit value from whether or not the detected LED driver module current substantially matches the nominal LED driver module current.

7. The LED lighting module according to claim 1, wherein the data processing device is arranged for receiving data from the LED driver module by:

detecting the LED driver module output voltage;

detecting if the LED driver module output voltage is in a voltage range above zero and below an LED forward ON voltage; and comparing, when the LED driver module voltage has been detected to be in the voltage range, the LED driver module voltage to a threshold, and deriving a data bit from the exceeding or not exceeding of the threshold.

8. The LED lighting module according to claim 1, wherein the data processing device is arranged for receiving data from the LED driver module by:

detecting the LED driver module output voltage;

determining a polarity of the LED driver module output voltage; and deriving data from the LED driver module output voltage if the polarity is inverse to a forward LED driving voltage.

9. The LED lighting module according to claim 1, further comprising a switch, connected in series with the LED, a control input of the switch being electrically connected to the data processing device for enabling the data processing device to control the switch.

10. The LED lighting module according to claim 1, wherein the data processing device is arranged for:

detecting an operating parameter of the LED;

comparing the detected operating parameter to a safe operating rating; and disconnecting the LED from the electrical power terminal in case a safe operating rating is exceeded.

11. The LED lighting module according to claim 10, wherein the operating parameter comprises at least one of: LED temperature, LED current, LED voltage, LED power, LED current as a function of temperature.

12. The LED lighting module according to claim 10, wherein the operating parameter comprises at least one of an accumulated number of power-ups, an occurrence of error conditions, an occurrence of LED driver module changes, the processing device being arranged for storing the operating parameter in the storage device.

13. The LED lighting module according to claim 1, wherein the data processing device is arranged for gathering and storing in the storage device at least one of LED operating voltage data, LED operating current data, LED operating temperature data, LED optical output data, LED position data, audio data, video data and for deriving a control signal from the stored data.

14. The LED lighting module according to claim 1, wherein the data processing device is arranged for controlling at least one of a LED intensity and LED color using the data stored in the storage device.

15. The LED lighting module according to claim 14, wherein the data processing device is arranged for controlling the LED intensity using the operating parameter as stored in the storage device, the operating parameter preferably comprising the accumulated operating time of the LED.

16. The LED lighting module according to claim 1, wherein the data processing device is arranged for detecting if an LED of the lighting module is defective, and for controlling the LED intensity on the basis thereof.

17. The LED fixture according to claim 1, wherein the data processing device is arranged for detecting if an LED of the lighting module is defective, and for de-activating the defective LED on the basis thereof.

18. The LED lighting module according to claim 1, wherein the data processing device is arranged to read from the memory device an identification of the LED lighting module, and to transmit the identification via at least one of the electrical power terminal and the LED.

19. The LED lighting module according to claim 18, wherein the identification comprises at least one of LED lighting module manufacturer identification, LED lighting module model name/type identification, LED lighting module serial number, LED lighting module configuration data.

20. The LED lighting module according to claim 1, wherein the data processing device is arranged for determining an accumulated operating time of the LED, detecting a dimming level of the LED and correcting the accumulated operating time for the dimming level.

21. The LED lighting module according to claim 1, wherein the data processing device is arranged for accumulating a number of LED current drive pulses provided to the LED, and for determining an accumulated operating time of the LED from the accumulated number of LED drive pulses.

22. The LED lighting module according to claim 20, wherein the data processing device is arranged for determining the accumulated operating time per LED group of the LED lighting module.

23. The LED lighting module according to claim 1, wherein the data processing device is arranged for sending data to the driver module in response to receiving from the driver module a polling signal.

24. The LED lighting module according to claim 23, wherein the data processing device is arranged for sending in response to receiving the polling signal, a response signal for indicating to the LED driver module that the LED lighting module has an event to report, the data processing device further being arranged to send data to the LED driver module concerning the event, in response to receiving from the LED driver module a message comprising an identifier of the LED lighting module.

25. The LED lighting module according to claim 23, wherein the data processing device is arranged to synchronize an operation of the LED lighting module with a rate of the polling signal received.

26. An LED lighting arrangement comprising:

an LED lighting module according to claim 1, and an LED driver module for driving the LED lighting module.

27. An LED lighting module comprising:

at least one LED;

the LED lighting module being configured to be connected to an LED driver module, the LED driver module comprising a converter for converting a power supply voltage into an LED driver module electrical output power for powering the at least one LED of the LED lighting module and a controller for controlling the converter, wherein the LED lighting module is configured to be powered by the LED driver module and wherein the LED lighting module does not comprise a converter for powering the at least one LED, wherein the LED lighting module further comprises:

an electrical power terminal, electrically connected to the LED, the electrical power terminal for electrically connecting the LED to the LED driver module to power the at least one LED from the LED driver module electrical output power as received from the LED driver module;

a storage device for storing data in relation to the LED; and a data processing device, electrically connected to the storage device for storing data in the storage device and reading data therefrom, the data processing device being arranged and connected for providing data communication via at least one of the electrical power terminal and the LED, wherein the data processing device is arranged to provide optical data transmission by the LED lighting module by:

sending an instruction signal via the electrical power terminal to the driver module, the instruction signal to make the driver module drive the LED accordingly to optically transmit the data.

28. An LED lighting arrangement comprising:

an LED lighting module according to claim 27, and an LED driver module for driving the LED lighting module.

29. An LED lighting module comprising:

at least one LED;

the LED lighting module being configured to be connected to an LED driver module, the LED driver module comprising a converter for converting a power supply voltage into an LED driver module electrical output power for powering the at least one LED of the LED lighting module and a controller for controlling the converter, wherein the LED lighting module is configured to be powered by the LED driver module and wherein the LED lighting module does not comprise a converter for powering the at least one LED, wherein the LED lighting module further comprises:

an electrical power terminal, electrically connected to the LED, the electrical power terminal for electrically connecting the LED to the LED driver module to power the at least one LED from the LED driver module electrical output power as received from the LED driver module;

a storage device for storing data in relation to the LED; and a data processing device, electrically connected to the storage device for storing data in the storage device and reading data therefrom, the data processing device being arranged and connected for providing data communication via at least one of the electrical power terminal and the LED, wherein the data processing device is arranged to provide optical data transmission by the LED lighting module by:

powering and depowering the LED from the electrical power terminal so as to make the LED optically transmit the data accordingly.

30. An LED lighting arrangement comprising:

an LED lighting module according to claim 29, and an LED driver module for driving the LED lighting module.

31. An LED lighting module comprising:

at least one LED;

the LED lighting module being configured to be connected to an LED driver module, the LED driver module comprising a converter for converting a power supply voltage into an LED driver module electrical output power for powering the at least one LED of the LED lighting module and a controller for controlling the converter, wherein the LED lighting module is configured to be powered by the LED driver module and wherein the LED lighting module does not comprise a converter for powering the at least one LED, wherein the LED lighting module further comprises:

an electrical power terminal, electrically connected to the LED, the electrical power terminal for electrically connecting the LED to the LED driver module to power the at least one LED from the LED driver module electrical output power as received from the LED driver module;

a storage device for storing data in relation to the LED; and a data processing device, electrically connected to the storage device for storing data in the storage device and reading data therefrom, the data processing device being arranged and connected for providing data communication via at least one of the electrical power terminal and the LED, and further comprising a photo amplifier having an output thereof electrically connected to an input of the data processing device.

32. The LED lighting module according to claim 31, wherein the photo amplifier is formed by the LED and an electronic amplifier having an input thereof connected to the LED, so as to use the LED as a photodiode.

33. An LED lighting arrangement comprising:

an LED lighting module according to claim 31, and an LED driver module for driving the LED lighting module.

34. An LED lighting module comprising:

at least one LED;

the LED lighting module being configured to be connected to an LED driver module, the LED driver module comprising a converter for converting a power supply voltage into an LED driver module electrical output power for powering the at least one LED of the LED lighting module and a controller for controlling the converter, wherein the LED lighting module is configured to be powered by the LED driver module and wherein the LED lighting module does not comprise a converter for powering the at least one LED, wherein the LED lighting module further comprises:

an electrical power terminal, electrically connected to the LED, the electrical power terminal for electrically connecting the LED to the LED driver module to power the at least one LED from the LED driver module electrical output power as received from the LED driver module;

a storage device for storing data in relation to the LED; and a data processing device, electrically connected to the storage device for storing data in the storage device and reading data therefrom, the data processing device being arranged and connected for providing data communication via at least one of the electrical power terminal and the LED, wherein the data processing device is arranged for activating the LED in case a predetermined operating condition is established.

35. An LED lighting arrangement comprising:

an LED lighting module according to claim 34, and an LED driver module for driving the LED lighting module.

36. An LED lighting module comprising:

at least one LED;

the LED lighting module being configured to be connected to an LED driver module, the LED driver module comprising a converter for converting a power supply voltage into an LED driver module electrical output power for powering the at least one LED of the LED lighting module and a controller for controlling the converter, wherein the LED lighting module is configured to be powered by the LED driver module and wherein the LED lighting module does not comprise a converter for powering the at least one LED, wherein the LED lighting module further comprises:

an electrical power terminal, electrically connected to the LED, the electrical power terminal for electrically connecting the LED to the LED driver module to power the at least one LED from the LED driver module electrical output power as received from the LED driver module;

a storage device for storing data in relation to the LED; and a data processing device, electrically connected to the storage device for storing data in the storage device and reading data therefrom, the data processing device being arranged and connected for providing data communication via at least one of the electrical power terminal and the LED, wherein the data processing device is arranged for storing an accumulated operating time of the LED lighting module in the storage device, the data processing device being arranged for generating an end of life signal using the accumulated operating time.

37. The LED lighting module according to claim 36, wherein the data processing device is arranged for transmitting the end of life signal by activating the LED.

38. The LED lighting module according to claim 37, wherein the data processing device is arranged for:

connecting for a signaling time period by means of the switch the LED to a supply for generating a signaling optical pulse.

39. An LED lighting arrangement comprising:

an LED lighting module according to claim 36, and an LED driver module for driving the LED lighting module.

* * * * *